United States Patent [19]

Hahn

[11] Patent Number: 4,939,332

[45] Date of Patent: Jul. 3, 1990

[54] SEALED FOOD PACKAGE FOR MICROWAVE HEATING

[75] Inventor: Herbert Hahn, Goettingen, Fed. Rep. of Germany

[73] Assignee: Conopco, d/b/A Thomas J. Lipton Co. Englewood Cliffs, N.J.

[21] Appl. No.: 316,990

[22] Filed: Feb. 28, 1989

[30] Foreign Application Priority Data

Mar. 8, 1988 [DE] Fed. Rep. of Germany ..... 3807445

[51] Int. Cl.[5] ..... H05B 6/80; B65B 29/08

[52] U.S. Cl. ..... 219/10.55 E; 219/10.55 F; 426/107; 426/113; 426/234; 426/243; 220/359; 99/DIG. 14

[58] Field of Search ..... 219/10.55 E, 10.55 F, 219/10.55 R; 426/107, 113, 114, 234, 241, 243; 99/DIG. 14; 220/359; 206/631; 229/903, 904

[56] References Cited

U.S. PATENT DOCUMENTS

| | | | |
|---|---|---|---|
| 3,271,169 | 9/1966 | Baker et al. | 219/10.55 E |
| 3,391,847 | 7/1968 | Christine et al. | 220/359 |
| 3,561,668 | 2/1971 | Bergstrom | 220/359 X |
| 4,013,798 | 3/1977 | Goltsos | 219/10.55 E |
| 4,399,159 | 8/1983 | Guibert | 426/113 |
| 4,413,167 | 11/1983 | Martel et al. | 219/10.55 E |
| 4,416,906 | 11/1983 | Watkins | 426/107 |
| 4,605,142 | 8/1986 | Itoh et al. | 220/359 |

*Primary Examiner*—Philip H. Leung

*Attorney, Agent, or Firm*—Brumbaugh, Graves, Donohue & Raymond

[57] ABSTRACT

Tray for containing food products that are to be heated up in a microwave oven, with an external foil cover and an internal closure film, the external cover providing a water vapor and oxygen barrier, while the internal film is permeable to microwaves.

6 Claims, 1 Drawing Sheet

SEALED FOOD PACKAGE FOR MICROWAVE HEATING

BACKGROUND OF THE INVENTION

The invention relates to a tray for containing food products that are to be heated up in a microwave oven, with a cover made from aluminium or an aluminium laminate.

Such food trays, which are known in particular as meal trays, have to be provided with a cover made from material including aluminium in its structure, in order to guarantee the required tightness properties. When the food is heated up by microwaves, this aluminium material has to be removed, however, as it does not allow microwaves to pass through. Putting open trays in a microwave oven is not ideal either, however, because the liquid would evaporate or splash out.

SUMMARY OF THE INVENTION

The purpose of the invention is to design a tray of the kind outlined above in such a way that the disadvantages described above are avoided.

In the solution to this problem proposed by the invention, a closure film made from plastic that is permeable to microwaves is provided below the external foil cover and is sealed to the tray.

When the tray is to be heated up in a microwave oven, the external foil cover is removed, while the internal closure film remains on the tray, so that splashing of liquid or uncontrolled evaporation are avoided. It is, however, possible to make a small hole in the internal closure film—with a pin, for example—before the tray is heated up, in order to prevent bulging.

In a very advantageous embodiment of the invention the rim of the tray has a stepped design, in which the inner, lower step is at the same level as the partition wall, while the outer step is slightly higher than the inner step and the partition wall, the closure film that is permeable to microwaves being sealed to the inner step and the top of the partition wall and the foil cover being sealed to the outer step.

This guarantees that the foil cover and the closure film are completely separated from each other, which makes it very much easier to remove them. It is also possible to enclose oxygen-absorbing agents in the space between them, which provide further protection for the packaged food during storage.

In a further advantageous embodiment of the invention the external foil cover is wrapped around the tray and is preferably closed on the base. This makes it possible to dispense with the outer packaging that is generally used otherwise.

BRIEF DESCRIPTION OF THE INVENTION

Two embodiments of the invention are shown in the drawings.

DETAILED DESCRIPTION OF THE INVENTION

Figure 1:
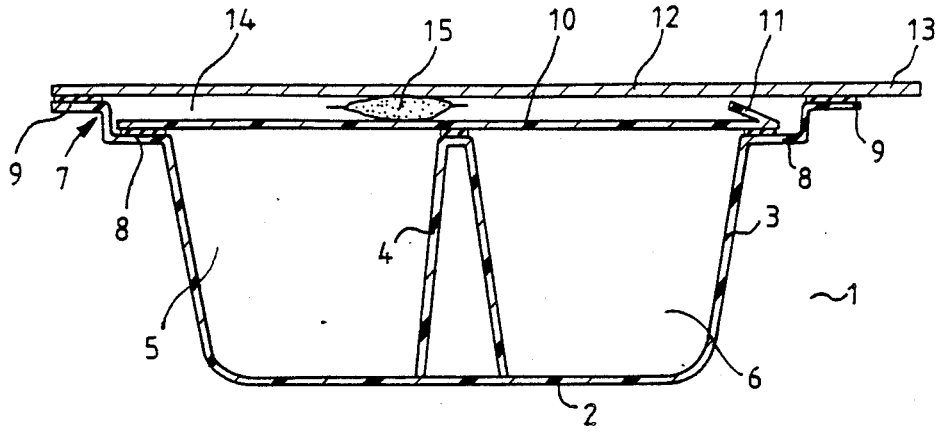
FIG. 1 is a cross-section of a meal tray with a partition wall, steps at the rim of the tray, a closure film and a film cover.

FIG. 1 is a cross-section of a meal tray 1 which has a base 2 and a wall 3. The space inside the meal tray 1 is divided up by a partition wall 4 into two compartments 5 and 6, in which food products (not illustrated) are stored. The meal tray 1 is provided with a stepped rim 7, the inner step 8 of which is at a lower level and is thus at the same height as the partition wall 4. The outer step 9 is higher than the inner step so that there is a gap between it and the partition wall 4.

A closure film 10 is sealed to the inner step 8 and the partition wall 4. This closure film 10 is made of plastic and lets microwaves through without having any appreciable effect on them. On its outside edge this closure film is provided with a tab 11 which facilitates opening of the sealed seams. An outer foil cover 12 is sealed to the outer step 9. This film cover 12 also has a tab 13 which facilitates removal of it from the meal tray. It is made from a material combination that contains aluminium and has a sealable plastic coating at least on the side facing the outer step 9. An oxygen-absorbing agent 15 packaged in a pouch is located in the space 14 between the foil cover 12 and the closure film 10.

Figure 2:
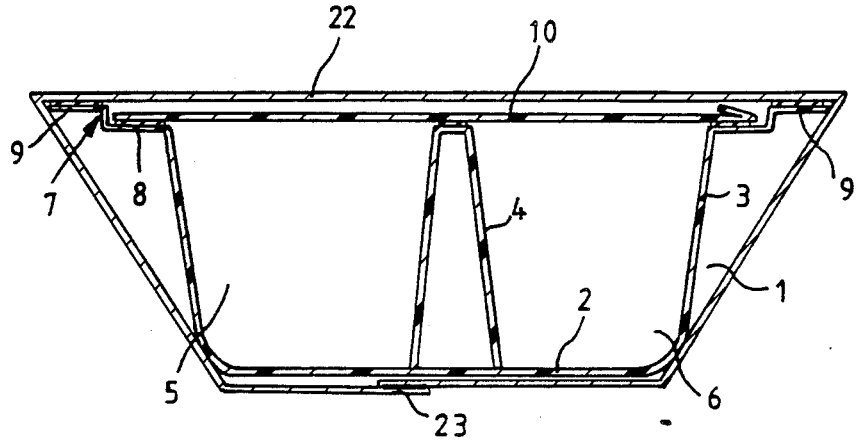
FIG. 2 is a cross-section of a similar meal tray, where the film cover is wrapped around the tray.

The embodiment illustrated in FIG. 2 shows an identical meal tray 1, which is closed in the same way. A foil cover 22 is sealed to the outer step 9 and in its continuation surrounds wall 3 before being closed in the area of the base 2 with the help of a longitudinal seam 23.

What is claimed is:

1. A package comprising:

a tray for receiving a food product to be packaged for microwave heating, said tray being formed from a material transparent to electromagnetic radiation and having a bottom wall, a sidewall extending upwardly from the periphery of the bottom wall and terminating at an upper end surrounded by an outwardly stepped rim having an inner step extending outwardly from the sidewall generally coplanar with the upper end of the sidewall, and having an outer step extending outwardly from the inner step and having an upper level disposed above the level of the inner step by a predetermined distance and lying in a plane parallel to the upper end of the sidewall, and partition wall means extending upwardly from the bottom wall and having an upper end at the level of the inner step of said rim and with said bottom wall and said sidewall defining a plurality of at least two compartments;

a radiation permeable plastic film extending over said tray in the plane of and peripherally sealed to the inner step of said stepped rim and sealed to the upper end of said partition wall means; and an external cover formed from sheet material opaque to electromagnetic radiation extending over said tray and overlying said plastic film, said external cover being sealed to the outer step of said stepped rim so as to be spaced from and sealed separately from said plastic seal whereby said external cover may be removed from the tray without disturbing the plastic seal.

2. A package as defined in claim 1, wherein said external cover substantially corresponds in shape and size to the perimeter of the outer step of said rim.

3. A package as defined in claim 1, wherein the sheet material of which said external cover is formed extends over the upper end of said tray over the outer step of said rim and is wrapped around the underside of said tray.

4. A package as defined in claim 3, wherein the sheet material of which said external cover is formed is sealably closed at the underside of said tray.

5. A package as defined in claim 1, wherein said sheet material comprises at least a sheet of aluminum.

6. A package as defined in claim 5, wherein said sheet material comprises a laminate which includes a sheet of aluminum.

* * * * *